United States Patent [19]

Tsujimoto et al.

[11] Patent Number: 4,976,473

[45] Date of Patent: Dec. 11, 1990

[54] WINDING APPARATUS FOR SHEET-SHAPED MOLDING MATERIAL

[75] Inventors: Yasuhiro Tsujimoto; Masayuki Kurita; Masaru Aoki, all of Shimizu, Japan

[73] Assignee: Takeda Chemical Industries, Ltd., Osaka, Japan

[21] Appl. No.: 305,104

[22] Filed: Jan. 31, 1989

[30] Foreign Application Priority Data

Feb. 4, 1988 [JP] Japan ..... 63-26176

[51] Int. Cl.[5] ..... B65H 18/04; B65H 19/28; B65H 23/00

[52] U.S. Cl. ..... 242/67.1 R; 242/74; 242/76; 242/68.4

[58] Field of Search ..... 242/76, 78.1, 78.7, 242/68, 68.1–68.7, 71.9, 67.1 R, 67.3 R, 67.2, 74; 53/111 R

[56] References Cited

U.S. PATENT DOCUMENTS

| | | | |
|---|---|---|---|
| 687,443 | 11/1901 | Succie | 242/76 |
| 1,088,039 | 2/1914 | Salmon, Jr. | 242/78.1 |
| 3,207,425 | 9/1965 | Haskin, Jr. et al. | 242/68.1 |
| 3,658,271 | 4/1972 | Austin et al. | 242/67.1 R |
| 3,932,980 | 1/1976 | Mizutani et al. . | |
| 3,955,772 | 5/1976 | Chisholm et al. | 242/78.7 |
| 4,211,375 | 7/1980 | Weiss et al. | 242/68.4 X |
| 4,652,117 | 3/1987 | Kogane et al. | 242/71.9 X |
| 4,750,660 | 6/1988 | Kamimura | 242/76 X |

FOREIGN PATENT DOCUMENTS

| | | | |
|---|---|---|---|
| 060964 | 9/1982 | European Pat. Off. | 242/78.1 |
| 966939 | 9/1957 | Fed. Rep. of Germany | 242/78.1 |
| 3104494 | 1/1982 | Fed. Rep. of Germany | 242/68 |
| 2070575 | 9/1981 | United Kingdom | 242/67.1 R |

*Primary Examiner*—John M. Jillions
*Attorney, Agent, or Firm*—Wenderoth, Lind & Ponack

[57] ABSTRACT

A winding apparatus for sheet-shaped molding material wherein slippage in the width direction can be prevented when the sheet-shaped molding material is wound around a winding core tube, because side plates are detachably mounted on both ends in the axial direction of the winding core tube. Thus, the slippage during the winding operation can be prevented, so that the weight of the molding material being wound can be increased, whereby a thick, wide thick molding compound can be rolled.

5 Claims, 15 Drawing Sheets

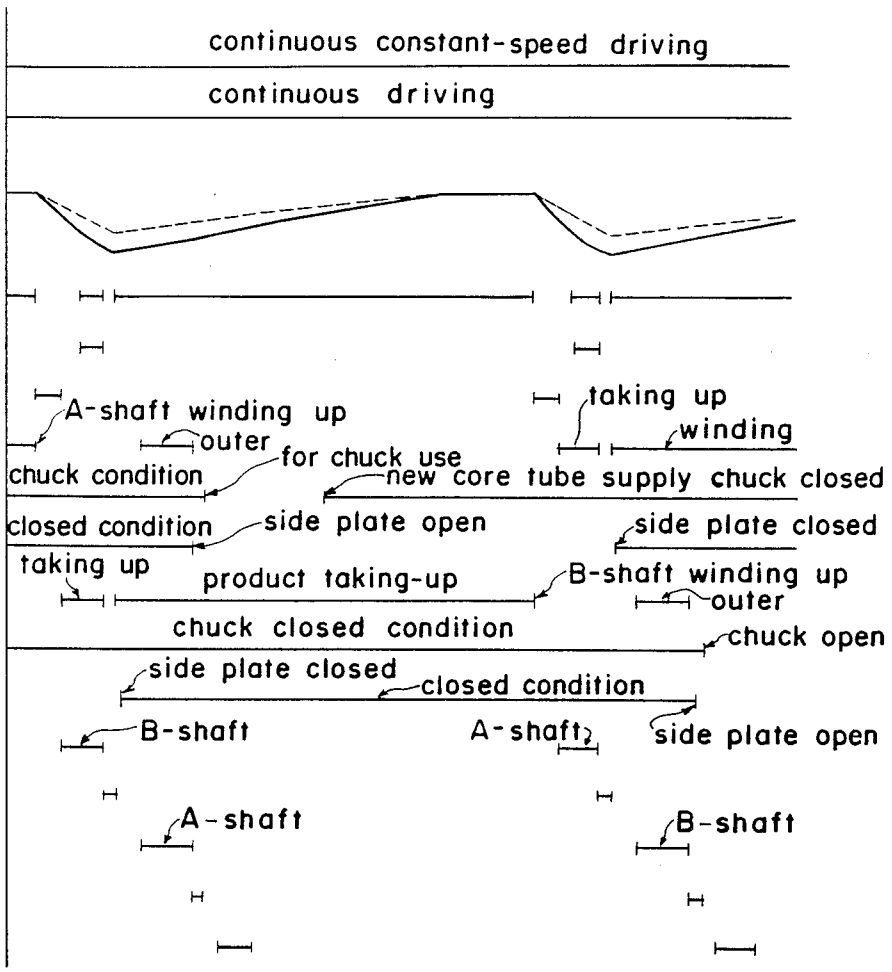

Fig. 9

1. impregnating machine main body
2. accumulator tork Mo
3. dancer roll position (top limit / reference apparatus / bottom limit)
4. tension cut delivering
5. delivering for winding case
6. product cutter operation
7. A-shaft winding
8. A-shaft chuck
9. A-shaft side plate
10. B-shaft winding
11. B-shaft chuck
12. B-shaft side plate
13. Extra-film
14. Extra-film
15. outer winding
16. outer film cutter
17. winder rotation

WINDING APPARATUS FOR SHEET-SHAPED MOLDING MATERIAL

BACKGROUND OF THE INVENTION

The present invention relates to improvements in a winding apparatus for a sheet-shaped molding material. More particularly, the present invention relates to an apparatus for winding, in a roll shape around a cylindrical core tube for subsequent transport and storage purposes, a sheet-shaped molding material, wherein both the top and bottom faces of a compound of a solid material such as glass fiber or the like and a paste-like material such as resin or the like, which compound material is continuously produced by an impregnating apparatus, are grasped between carrier films. The core tube is detachably mounted in and rotated by the winding apparatus, which has a pair of right and left winding sections for winding the sheet-shaped molding material, and after the winding operation of the sheet-shaped molding material around the core tube disposed in one of the winding sections has been finished, the winding is next effected around a core tube disposed in the other of the winding sections. The winding apparatus sequentially winds the sheet-shaped molding material which is continuously fed in a roll shape around the core tube by the repetition of the above procedure.

Conventionally, a flexible sheet-shaped molding material grasped between carrier films is a compound composed of a paste-like material chiefly made of resin and impregnated with glass fiber. It is difficult to retain the shape thereof immediately after the impregnation in the impregnating apparatus, thus resulting in various problems during the winding operation around a cylindrical winding core tube for subsequent transport and storage purposes. Namely, in the winding step, a winding slippage is likely to be caused by the movement of the compound between the carrier films when the sheet-shaped molding material is wound up in a roll shape due to the pulling force on the material, such winding slippage being caused when the roll diameter is approximately 300 mm or more, and such slippage makes it impossible to effect further winding. Thus, conventionally one roll of the sheet-shaped molding material wound around the cylindrical core tube has a weight of 150–160 kg as its limit, and normally is only 100 kg. However, because the weight of one roll is so low, more time and labor is required for the roll change-over during the production, thus resulting in poor productivity. The number of rolls needed is increased for a press molding operation of large-sized moldings even by a user, which manufactures moldings by the use of this type of molding material. Thus, the weight of one roll should be increased if only for this reason. Especially, as requests for the rationalization of molding processes are recently increased because of higher personnel costs and so on, press molding operations using a molding material such as SMC (sheet molding compound), TMC (thick molding compound), BMC (bulk molding compound) or the like are becoming common, such as the hand lay up method, spray up method requiring many holds as molding methods for the moldings. Furthermore, because the moldings are becoming bigger in size such as bathtubs, water-proof pans, bathtubs with wash basins attached thereto, and so on, molding materials which are bigger, thicker, and wider are being demanded. However, winding is not used for the TMC molding material, because in the case of thick, wide TMC, the weight per unit area becomes larger, the thickness is difficult to make uniform, and winding slippage is likely to result. Therefore, the molding material is supplied in a sheet-shaped casing, which causes a problem that the productivity is lower, and also requirements for larger size sheets are hard to satisfy.

SUMMARY OF THE INVENTION

Accordingly, the present invention has been developed with a view to substantially eliminating the above discussed drawbacks inherent in the prior art. The essential object thereof is to provide a winding apparatus for a sheet-shaped molding material which is capable of positively preventing winding slippage during the winding operation, thereby making it possible to increase the weight of the molding material which can be wound on a core tube.

Another important object of the present invention is to provide a winding apparatus for a sheet-shaped molding material of the above-described type which is capable of increasing the weight which can be wound so that the sheet-shaped molding material to be wound onto one roll can be made larger in size, and in particular, the thicker, wider TMC may be wound.

In accomplishing these and other objects, according to the embodiment of the present invention, there is provided a winding apparatus for a sheet-shaped molding material, wherein a sheet-shaped molding material with top and bottom faces of a compound composed of a solid material such as glass fiber or the like and a paste-like material such as resin or the like greased with carrier films is continuously produced by an impregnating apparatus, and the thus formed sheet-shaped molding material is continuously fed by the impregnating apparatus and is sequentially wound up around the winding core tube, characterized in that a plurality of winding sections are provided on the winding apparatus, each of the winding sections being provided with a means for liftably holding the winding core tube in a winding position, with a chuck which is detachably engaged with both the right and left ends of the winding core tube so as to retain the winding core tube in a winding position, and a driving mechanism for the chuck, and a side plate which is detachably engaged on both the right and left ends of the winding core tube held in the winding position so as to restrict the width of molding material being wound on the winding core tube to prevent slippage of the molding material, and a driving mechanism for the side plate.

According to the present invention, because a side plate is detachably mounted on the winding core tube during the winding operation so as to restrict the movement of the sheet-shaped molding material to be wound around the core tube in the width direction of the molding material, it is possible to prevent slippage during the winding of the molding material onto the core tube. Thus, the weight which can be wound onto the core can be increased from the conventional 100 kg to 1,000 kg. Needless to say, it may be used for winding the thin SMC, but it is especially useful for winding the TMC with a thickness (5–10 mm or so) approximately three times that of the SMC. The large-sized sheet-shaped molding materials composed of this type of SMC or TMC are especially suitable materials for large-size moldings for the various applications of the press molding method. For example, housing fixtures such as bathtubs, water-proof pans, water tank panels, balconies and so on; automobile appliances such as air spoilers, air intakes, roofs, side panels, engine hoods, and so on; and chains, trays, parabolic antennas and so on can be suitably manufactured.

Furthermore, in the winding apparatus of the present invention, the start of take-up can be smoothly effected, because at the start of winding onto the core tube, the sheet-shaped molding material is so arranged as to be wound by being guided by a film after the guiding film has been wound around the core tube.

BRIEF DESCRIPTION OF THE DRAWINGS

These and other objects and features of the present invention will become clear from the following description of the preferred embodiments thereof and with reference to the accompanying drawings, in which:

FIG. 9 is an operation time chart of each part of the apparatus during the winding and the winding change-over;

DETAILED DESCRIPTION OF THE INVENTION

Figure 1:
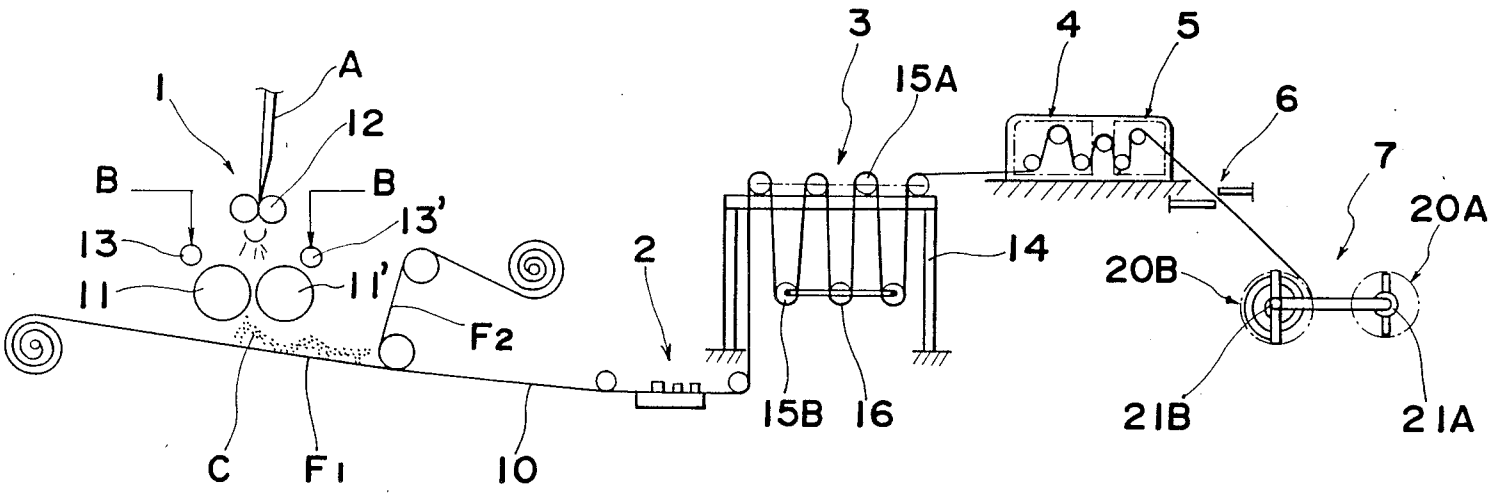
FIG. 1 is a schematic view showing manufacturing facilities for sheet-shaped molding material.
Figure 2:
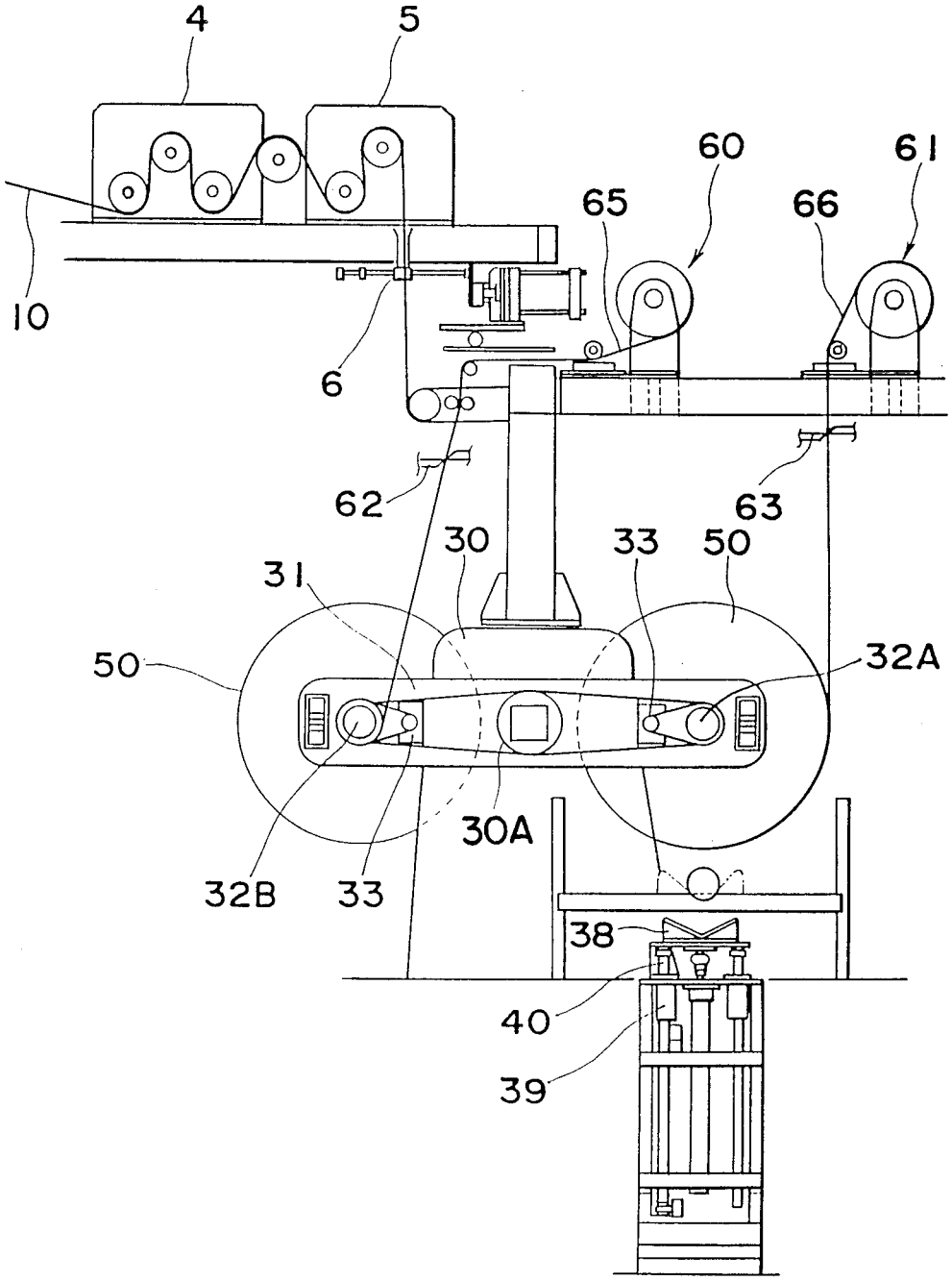
FIG. 2 is a side view showing a winding apparatus portion thereof.

Before the description of the present invention proceeds, it is to be noted that like parts are designated by like reference numerals throughout the accompanying drawings.

Referring now to the drawings, there is schematically shown manufacturing facilities for sheet-shaped molding material. In FIG. 1, an impregnating apparatus 1, an apparatus 2 for folding edges, an accumulator 3, a tension cut delivering apparatus 4, a delivering apparatus 5 for winding use, a product cutter 6, and a winding apparatus 7 are sequentially disposed from an upstream position to a downstream position. The sheet-shaped molding material 10 formed by the impregnating apparatus 1 is wound in a roll shape for storage and movement by the winding apparatus 7 after it has been carried sequentially through the apparatuses 2, 3, 4, 5 and 6.

As the present invention relates to the construction of the winding apparatus 7 and the winding method carried out thereby, the construction other than the winding apparatus 7 will be schematically described hereinafter.

In the impregnating apparatus 1, the glass roving A is cut into lengths of 1" by a glass cutter 12 above a pair of impregnating rollers 11, 11' after which it drops onto the impregnating rollers 11, 11'. Paste-like material B is spread from the supplying pipes 13, 13' onto the surfaces of the impregnating rollers 11, 11' so that the paste-like material B is impregnated with the glass rovings to form compound C during its passage through the gap between the impregnating rollers 11 and 11'. The impregnated compound C is dropped onto the lower-face carrier film $F_1$ for carrying the compound. Then, an upper-face carrier film $F_2$ is fed from above and is placed on the top surface of the compound C so as to complete formation of a sheet-shaped molding material 10, with both the top and bottom faces of the compound C being supported by the carrier films $F_1$, $F_2$. At this point, excess compound C at both the edges in the width direction of the upper and lower carrier films $F_1$, $F_2$ extends about 10 cm from both the edges of the molding material 10, with both the edges of the compound C being exposed. An apparatus 2 for folding both edges is disposed immediately after the impregnating apparatus 1. Both the side edges of the compound C in the direction of the width of the carrier films $F_1$ and $F_2$ are folded to form an edge portion so as to prevent the compound within the sheet-like material from leaking from between the films in the width direction during the winding operation.

The above-described sheet-shaped molding material 10 is adapted to be wound in a roll shape by a winding apparatus 7. The winding apparatus 7 has a pair of winding sections, a left or A-side winding section 20A and a right or B-side winding section 20B therein. The winding sections 20A and 20B have one winding core tube 21A and one winding core tube 21B, respectively, which are detachably mounted therein. After the winding operation of winding material on the core tube 21A of winding section 20A has been completed, the molding material is wound around the core tube 21B of the other winding section 20B. The molding material 10 continuously produced by the impregnating apparatus 1 is wound into rolls by the winding apparatus 7, which periodically effects a change-over operation between the winding section 20A and the winding section 20B.

It is required to temporarily stop the supplying of the sheet-shaped molding material 10 to the winding apparatus 7 at the time of a change-over of the winding between the winding sections 20A and 20B. Because the molding material 10 is continuously produced by the impregnating apparatus 1 so as to feed it toward the winding apparatus, the accumulator 3 is provided to store the molding material 10, with the molding material 10 having its tension maintained during the temporary stopping of the winding apparatus 7. The accumulator 3 has a plurality of (four) upper rolls 15A rotatably disposed on the top side of the frame 14 at intervals, and it has a plurality of (three) lower or dancer rolls 15B rotatably disposed at intervals along a roll support plate 16 which is vertically suspended below the top of frame 14, with the molding material 10 being sequentially entrained from the inflow end between alternating upper rolls 15A and lower rolls 15B.

In the accumulator 3, the lower rolls 15B are raised or lowered in accordance with the amount of molding material accumulated. As the accumulated amount increases at the time of change-over of the winding apparatus, the lower rolls 15B are lowered. On the other hand, when the winding operation is resumed, the amount accumulated is decreased to cause the lower rolls 15B to rise.

A tension cut delivering apparatus 4 is provided at the outlet of the accumulator 3 and is driven to make it possible to control the position of the dancer rolls (lower rolls 15B) of the accumulator 3, and at the same time, to control the winding tension in the winding apparatus. A delivering apparatus 5 for delivering molding material to the winding apparatus is connected with the apparatus 4 and is driven when the winding is resumed after the completion of a change-over operation. A molding material cutter 6 disposed near the exit of the apparatus 5 is s positioned as to be able to cut the sheet-shaped molding material 10 at the completion of the winding on one core tube 21.

The construction of the winding apparatus 7 is shown in FIGS. 2–8, 10 and 11. A frame means is provided which is a pair of spaced parallel main bodies 31 are rotatably supported on a shaft 30*a* on the front and rear of the base 30 for rotation through 180° as shown by an arrow in FIG. 10(4). A pair of winding sections 20A and 20B are provided on the respective left and right ends of each winder main body 31. An A support shaft 32A and a B support shaft 32B are respectively rotatably and slidably mounted on the respective ends of the main bodies 31. The outer ends of each of the support shafts 32A and 32B are coupled through a lever 35 and a bearing 36 respectively to an operation rod 34 of a corresponding air cylinder 33 for opening and closing a chuck mounted on the winder main body 31, and a conical trapezoidal chuck 37 is secured to the inner end of each of the support shafts 32A and 32B. A cylindrical core tube 21 is supported between support means in the form of front and rear chucks 37. Each chuck 37 is inserted into the core tube 21 through movement of the front and rear chucks 37 toward each other so as to support the core tube 21 therebetween. The chucks 37 are taken out of the core tube 21 by movement away from each other to release the core tube 21. In order to position a cord tube 21 between the front and rear chucks 37, a core tube receiver 38 is placed in a position below the chucks 37, and is secured to the top end of the operation rod 40 of a hydraulic cylinder 39, so that a core tube 21 can be located between the chucks 37 by the operation of the hydraulic cylinder 39 so as to raise the receiver 38. The receiver 38 is lowered after the tube has been retained by the chucks 37. Also, sprockets 41 for driving the tubes 21 are secured onto the respective support shafts 32A and 32B and a chain 49 is entrained around the sprockets 41 and is driven by a motor shown schematically at M for causing the core tube 21 to rotate through the chucks 37 for winding.

Figure 3:
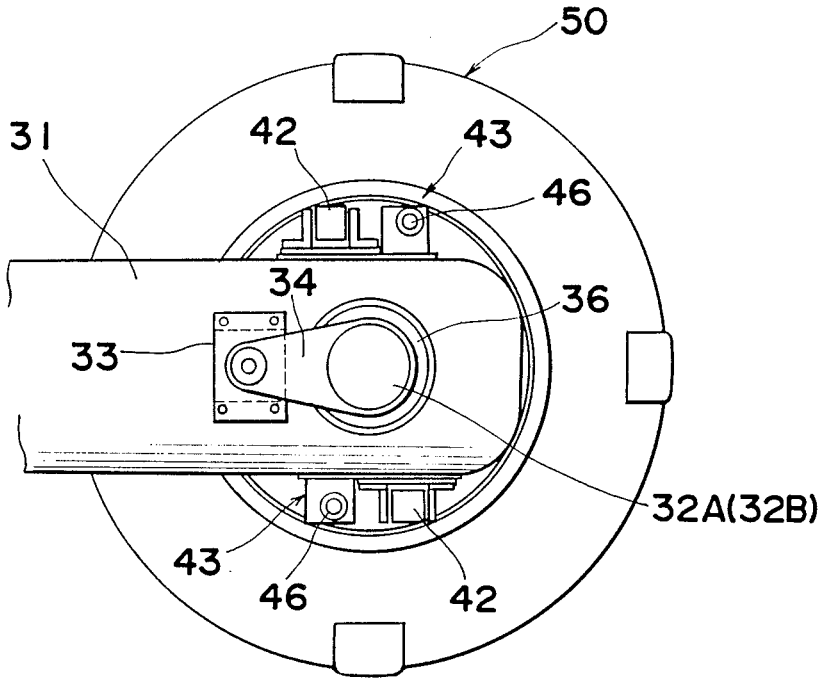
FIG. 3 is a side view showing a side plate and a chuck portion for each of the winding shaft sections.
Figure 4:
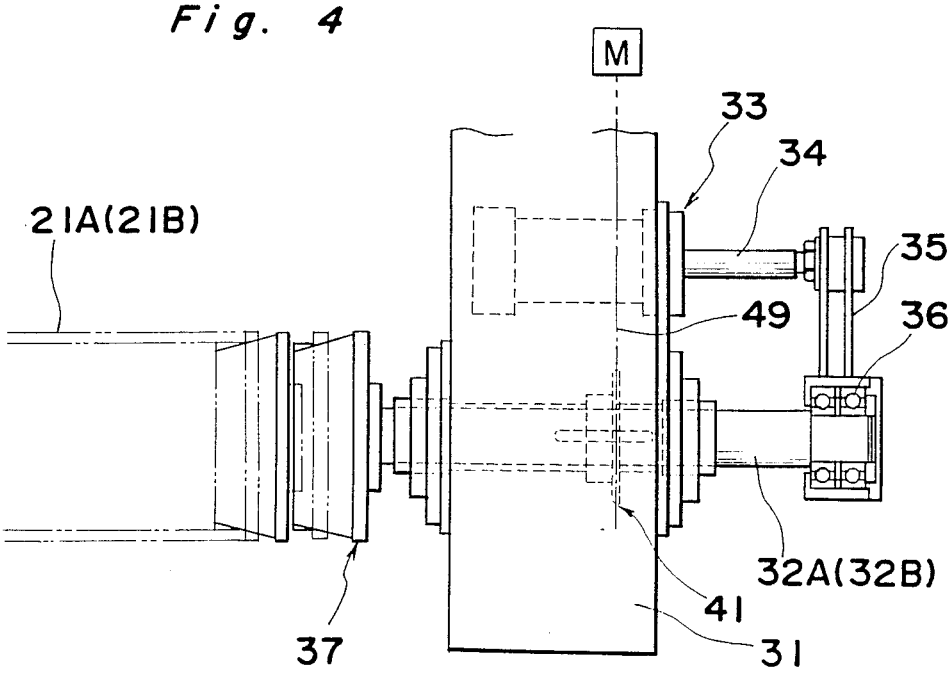
FIG. 4 is a plan view of a winder and a chuck for the winding section.
Figure 5:
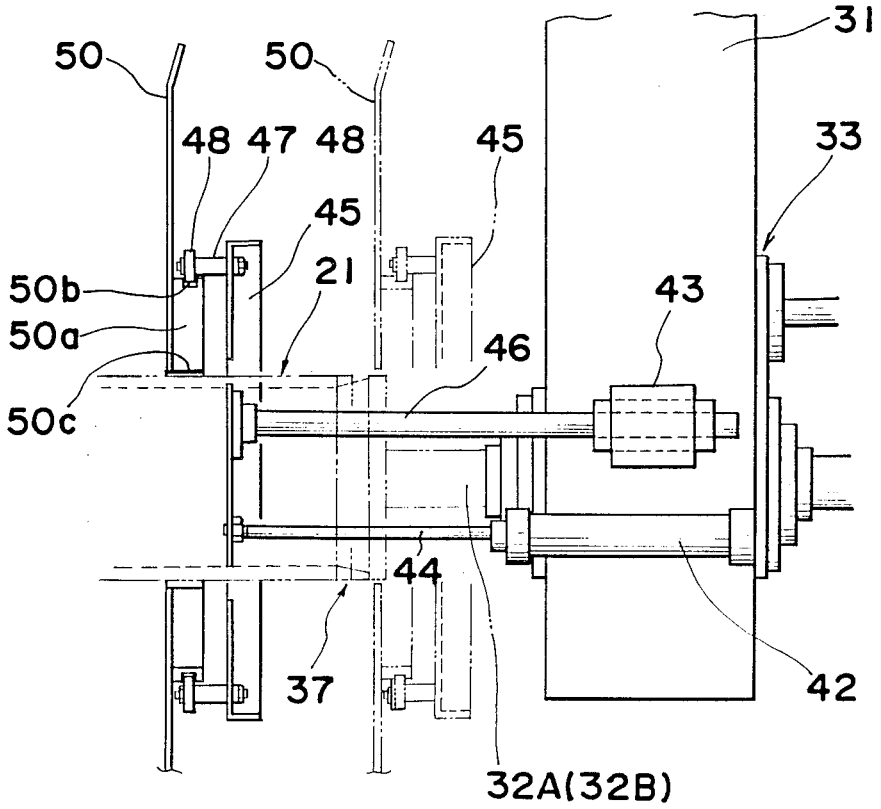
FIG. 5 is a plan view showing the operation condition of a side plate.

As shown in FIGS. 3 and 5, air cylinders 42 for opening and closing a side plate are positioned at both the top and bottom parts of both ends of the main bodies 31, and a side plate guide bearing 43 is disposed adjacent to each of the air cylinders 42. The tip end of the operating rod 44 of each air cylinder 42 is secured to a side plate support plate 45, and a guide shaft 46 secured to the side plate support plate 45 is slidably engaged in the side plate guide bearing 43. Guide rollers 48 are rotatably mounted on support shafts 47 on a side plate support plate 45, with the guide rollers 48 being engaged in a groove portion 50*b* of a bearing portion 50*a* secured to each disc-shaped side plate 50 as shown. A shaft hole 50*c* is provided in the central portion of the side plate 50 and the bearing portion 50*a* thereof, so that the core tube 21 and the chuck 37 can freely pass through the shaft hole 50*c*. These side plates 50 are axially operated by the air cylinders 42 for opening to the chain line position as shown in FIG. 5, and then operated in a closing direction so as to approach closer to each other, and are rotated during the winding operation.

Figure 8:
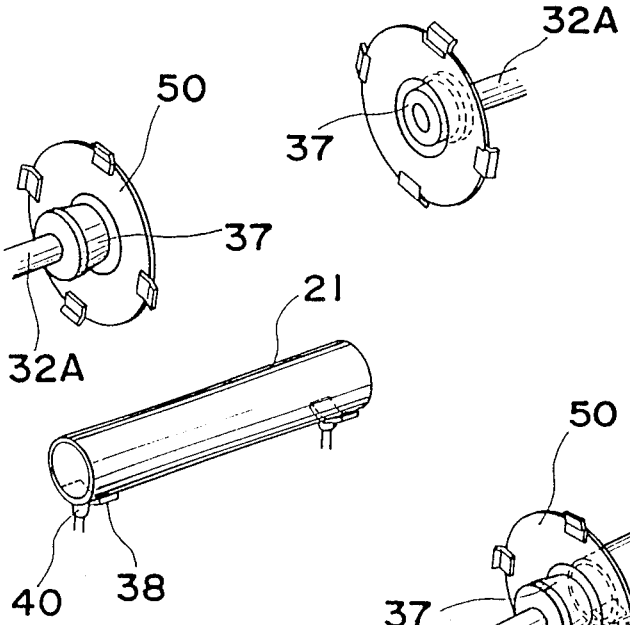
FIGS. 8(1) through 8(11) are perspective views showing the operating sequence in the winding section.
Figure 8:
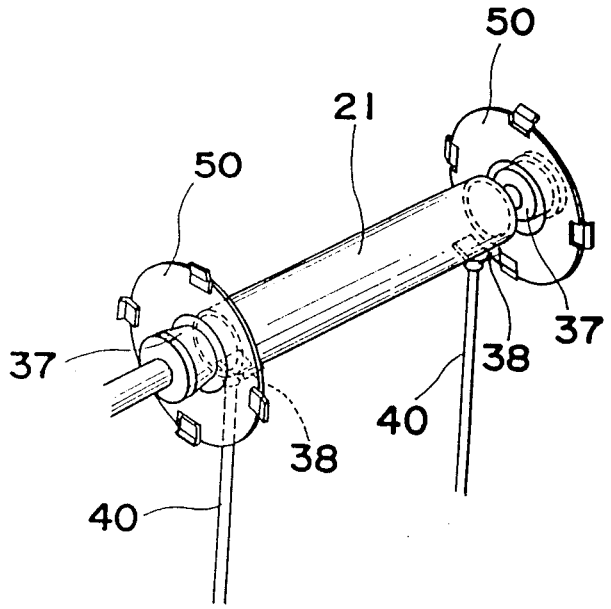
Figure 8:
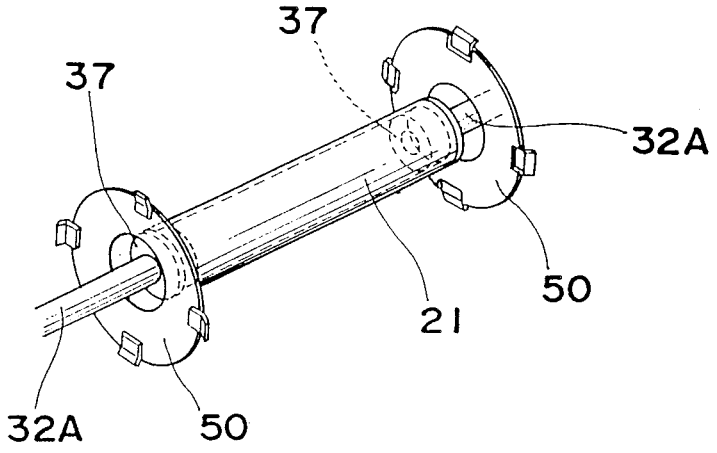
Figure 8:
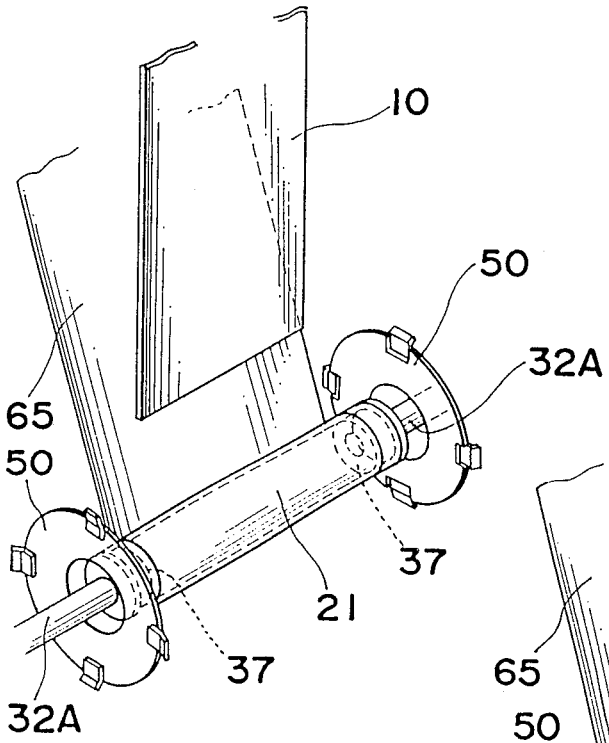
Figure 8:
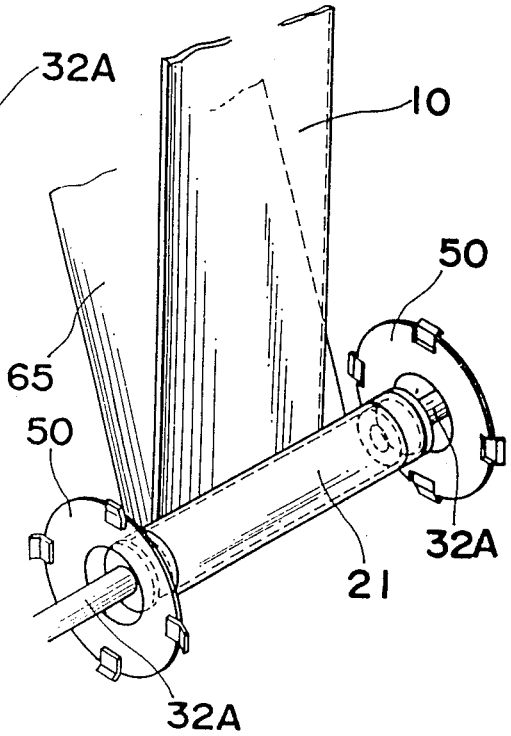
Figure 8:
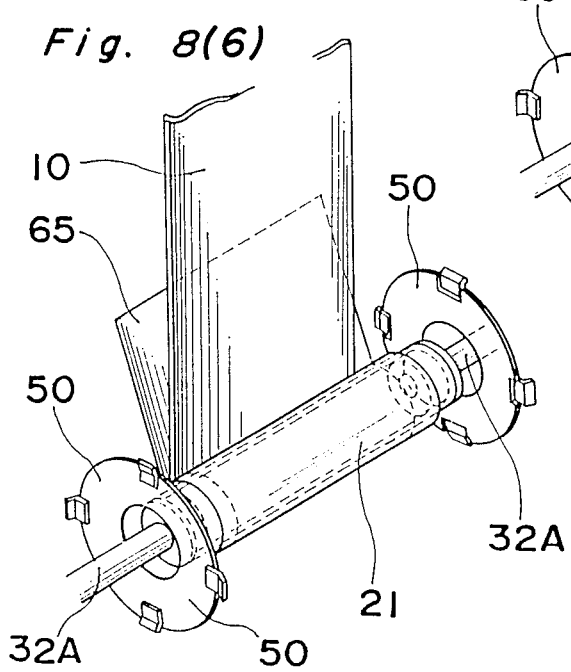
Figure 8:
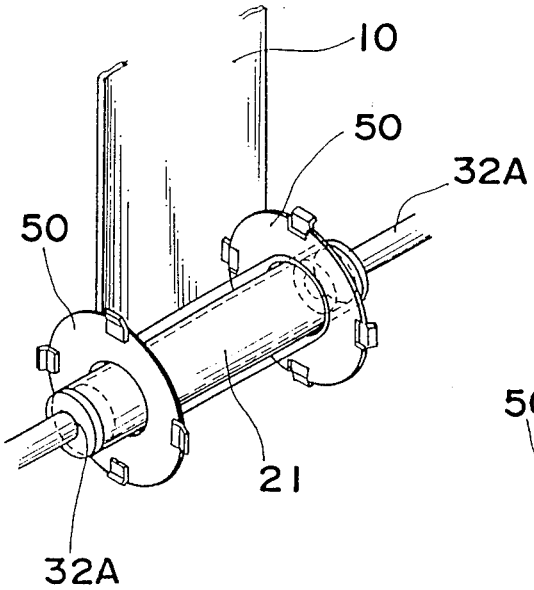
Figure 8:
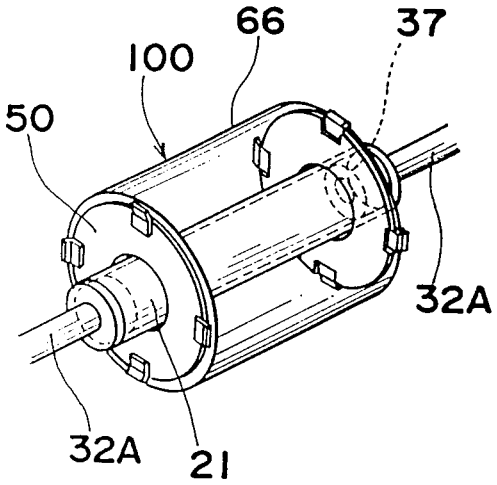
Figure 8:
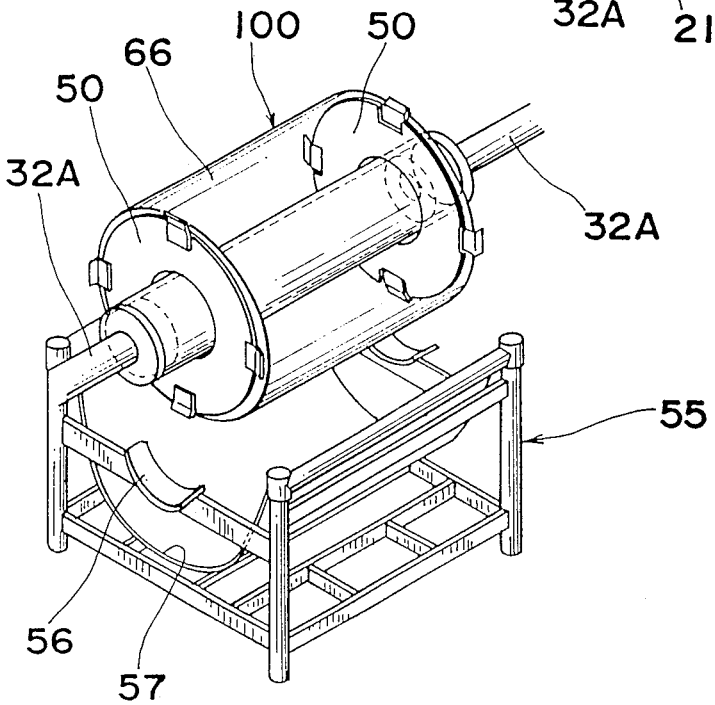
Figure 8:
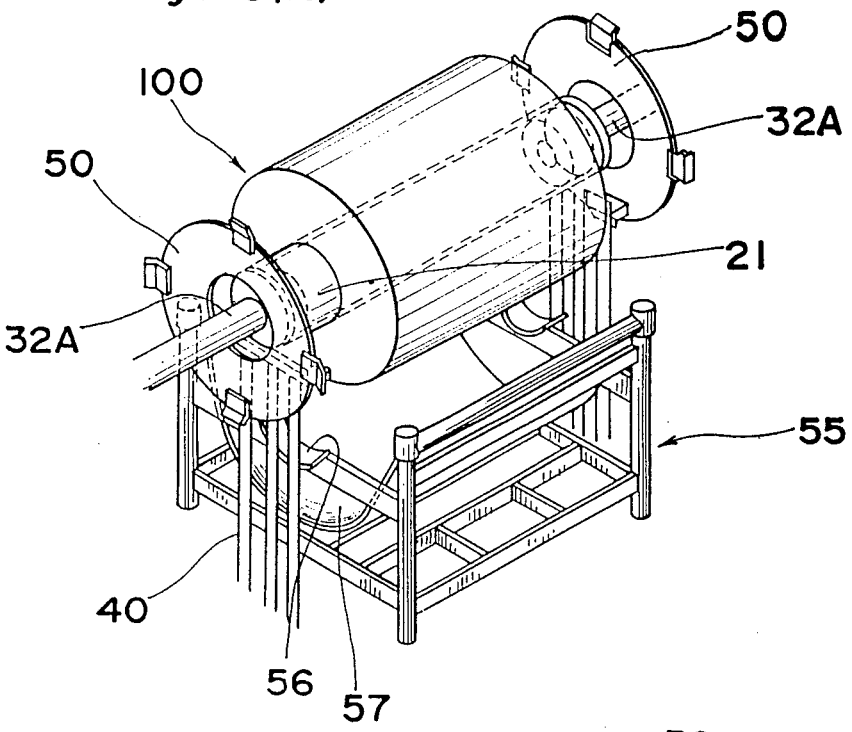
Figure 8:
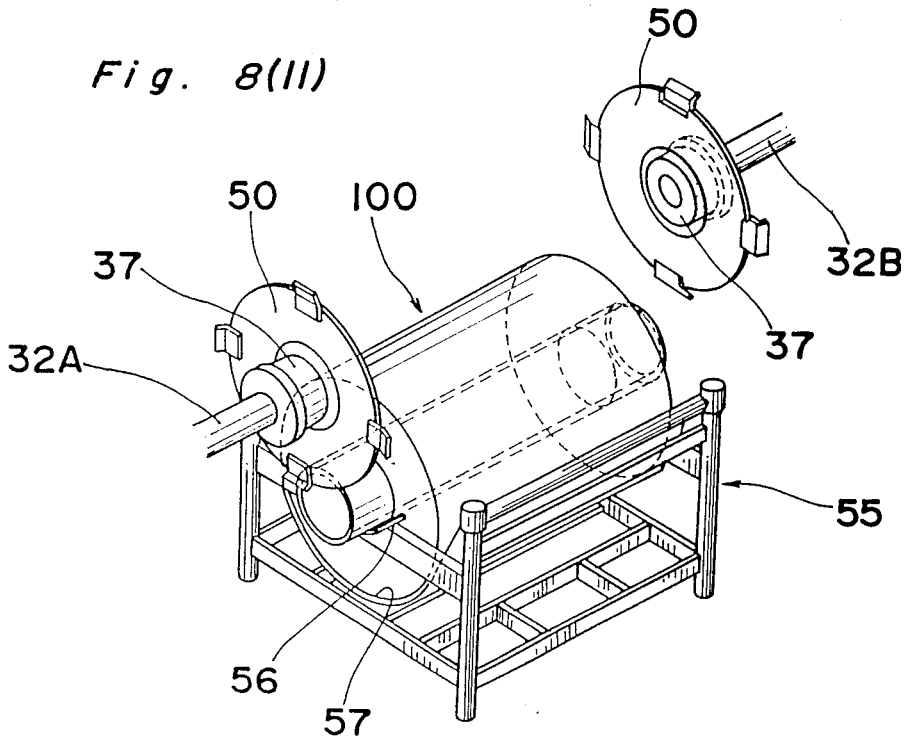

A product receiving section 55 (shown in FIG. 8(10)) for receiving the product 100 from the winding section after the completion of the winding of the sheet-shaped molding material 10 is disposed in a position under the core tube 21. A bearing section 56 for supporting both the end portions of the winding core tube 21 and an accommodating section 57 for receiving the lower half of the product 100 are provided in the product receiving section 55.

A guide film delivering apparatus 60 and an outer film delivering apparatus 61 are disposed above a pair of winding sections on the winder 31, and a guide film cutter 62 and an outer film cutter 63 are provided at the delivering side of each apparatus. A guide film 65 delivered by the film delivering apparatus 60 is first wound around the core tube 21 at the start of the winding operation of the sheet-shaped molding material 10 and the sheet-shaped molding material 10 is inserted between the turns of the film 65 so that the winding is effected, the molding material 10 being guided onto the core tube 21 by the guide film 65. Also, an outer film 66 delivered from the outer film delivering apparatus 61 is wound around the completed roll of molding material 10 after the completion of the winding of the sheet-shaped molding material 10 around the core tube 21, and the core tube 21 is disengaged from the winding section after the completion of winding the outer film 66 onto the completed roll.

The operation of the winding apparatus will be described hereinafter.

Figure 6:
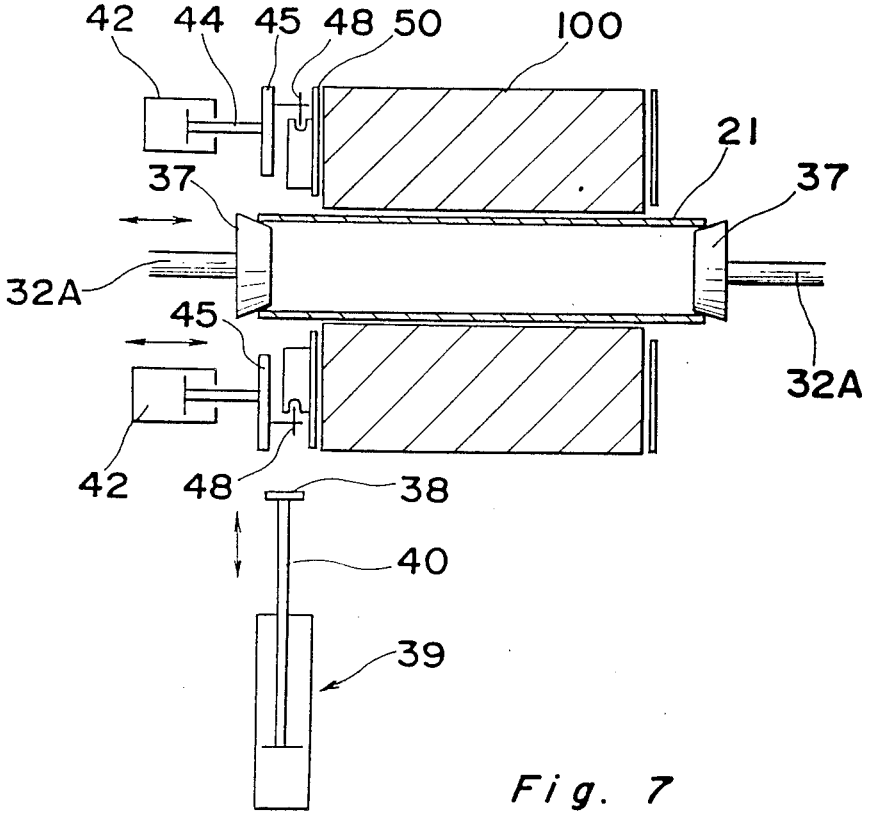
FIG. 6 is a schematic sectional view of part of the apparatus immediately after the winding has been effected by the winding apparatus.
Figure 7:
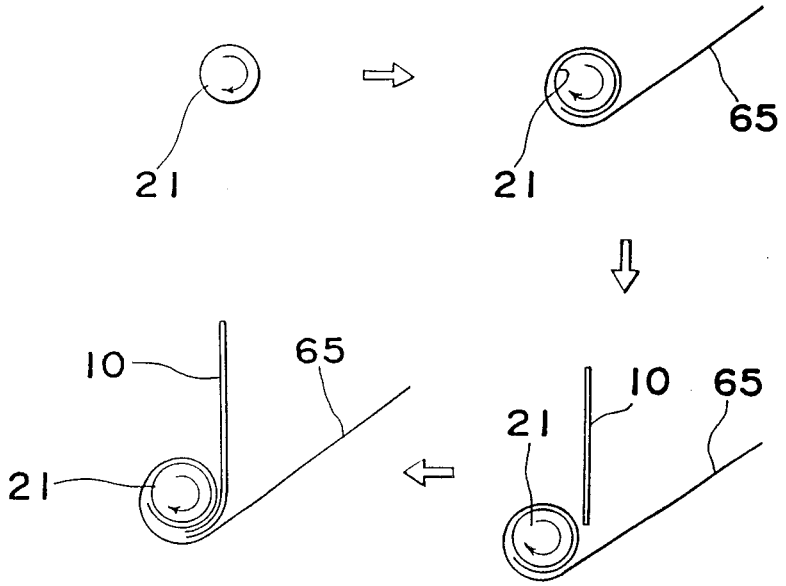
FIG. 7 is a series of diagrams showing the operation at the start of the winding onto the core tube.

In the present winding apparatus, as shown in FIG. 6, the core tube 21 is retained by chucks 37 during the winding operation and side plates 50 slidable on both ends of the core tube 21 are pressed against the ends of the roll of sheet-shaped molding material being wound for restricting the slip of the sheet-shaped molding material 10 in the width direction so as to prevent slippage during the winding operation. As shown in FIG. 7, the guide film 65 is wound around the core tube 21 at the start of winding of the sheet-shaped molding material 10 and the guide film 65 grasps the leading edge of the sheet-shaped molding material 10 between the turns of the film 65, so that the sheet-shaped molding material 10 is guided onto and wound on the tube 21 by the film 65.

The sequence of engaging the core tube 21 and positioning the side plates 50, winding the sheet-shaped molding material 10, and disengaging the completed roll after the completion of the winding will be described hereinafter in connection with FIGS. 8(1) through 8(11).

As shown in FIG. 8(1), the core tube 21 onto which the sheet-shaped molding material 10 is to be wound around is supported below chucks 37 on the core tube receivers 38 mounted on the rods 40 of the hydraulic cylinder 39, and the chucks 37 and the side plates 50 on both ends are supported in the positions shown by the rods on the air cylinders 33 and 42 on the winder main body 31.

Then, as shown in FIG. 8(2), the rods 40 of the hydraulic cylinders 39 are raised so as to set the core tube 21 in alignment with the chucks 37 and the side plates 50. Then, as shown in FIG. 8(3), the air cylinders 33 for opening and closing the chucks are driven to pull the rods 34 so as to move the chucks 37 inwardly through the levers 35 and the support shafts 32A for inserting the chuck into the openings at both ends of the core tube 21 so as to support the core tube 21 on the chucks 37. The side plates 50 are not engaged with the core tube 21 and are positioned externally thereof on both ends of the core tube 21. In this condition, the guide film 65 is started to be wound around the core tube 21 as shown in FIG. 8(4). After the required number of turns has been effected, the sheet-shaped molding material 10 is inserted between the turns of the film 65 as shown in FIG. 8(5), so that the sheet-shaped molding material 10 starts to be wound around the core tube 21, being guided by the film 65. After the sheet-shaped molding material 10 has been wound a predetermined number of times around tube 21 the guide film 65 is cut as shown in FIG. 8(6) so that no further guide film 65 is wound and only the sheet-shaped molding material 10 is wound around the core tube 21 as shown in FIG. 8(7). At this time, the side plates 50 are moved inwardly towards each other by the rods 44 of the air cylinders 42, the winding of the guide film 65 having been stopped. In this movement, the interval between the right and left side plates 50 is set to be almost equal to the width of the sheet-shaped molding material 10 so as to prevent slippage, which is caused by the lateral slip of the sheet-shaped molding material 10 during winding. The sheet-shaped molding material 10 is wound around the core tube 21 only to the desired diameter (which is reached when material 10 reaches to the outer peripheral edge of the side plates 50 as shown in FIG. 8(8)), with the slippage being prevented by the side plates 50 as described hereinabove. After the winding operation of the sheet-shaped molding material 10 has been completed, the outer film 66 is wound on the outer peripheral face of the roll of sheet-shaped molding material so as to protect the wound sheet-shaped molding material 10.

After the sheet-shaped molding material 10 has been wound around the core tube 21 and protected by the outer film 66 in the manner as described hereinabove, into a completed product 100, the product receiving section 55 is moved into position below the product 100 as shown in FIG. 8(9). Then, as shown in FIG. 8(10), the side plates 50 are moved away from each other by the operation of the air cylinders 42 so as to be disengaged from the core tube 21. At the same time, the hydraulic cylinders 39 are driven to raise the core tube receivers 38 for supporting both ends of the core tube 21, and the air cylinders 33 are then operated so as to pull the chucks 37 out of the core tube 21. After the side plates 50 and the chucks 37 have been removed from the core tube 21, both ends of the core tube 21 are lowered onto the bearing section 56 of the product receiver 55 as shown in FIG. 8(11). At this time, the side plates 50 and the chucks 37 are restored into their original positions shown in FIG. 8(1) in the winding section 20A in readiness for the next winding operation.

Figure 10:
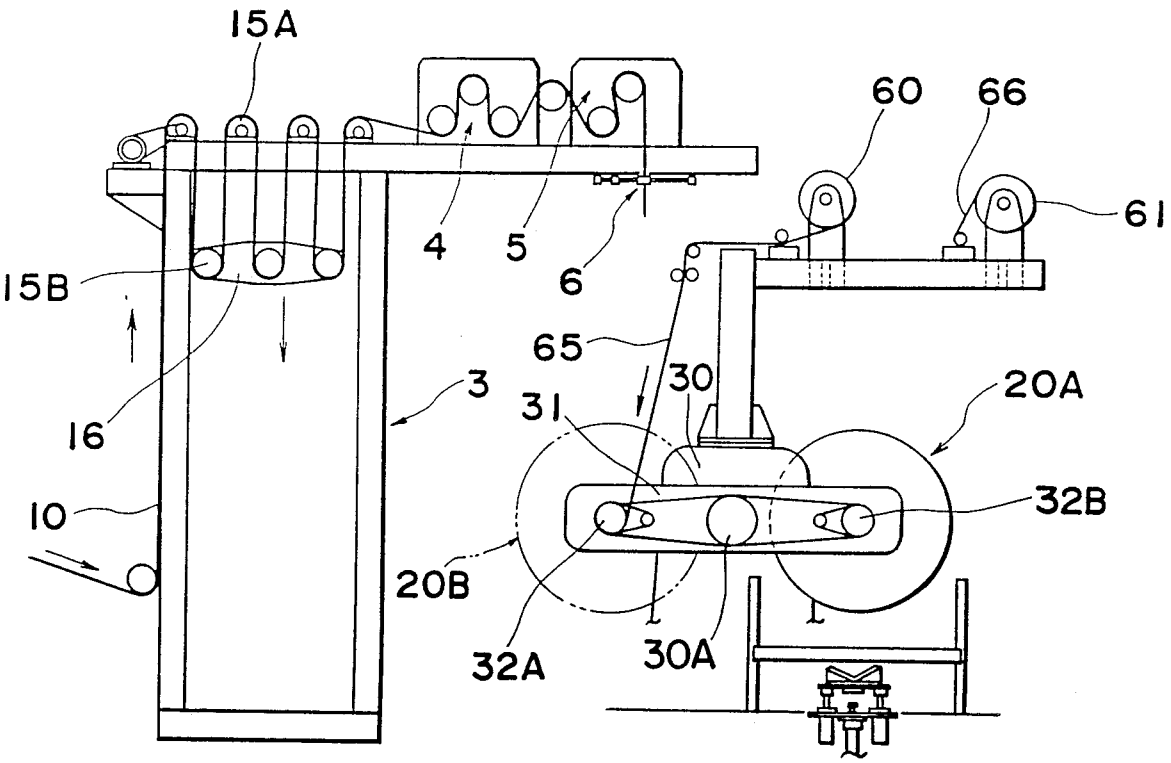
FIGS. 10(1) through 10(4) are elevation views showing the movement of a sheet-shaped molding material and an extra film in an accumulator and a winding apparatus during the winding and the winding change-over.
Figure 10:
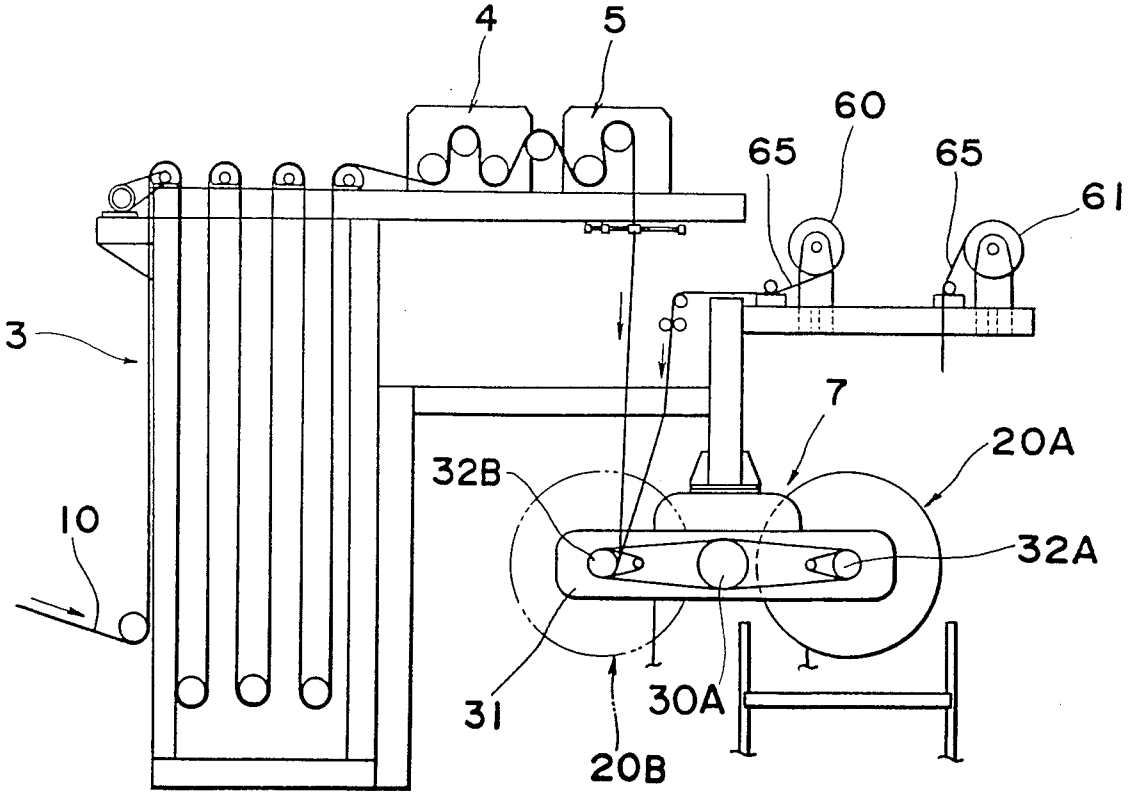
Figure 10:
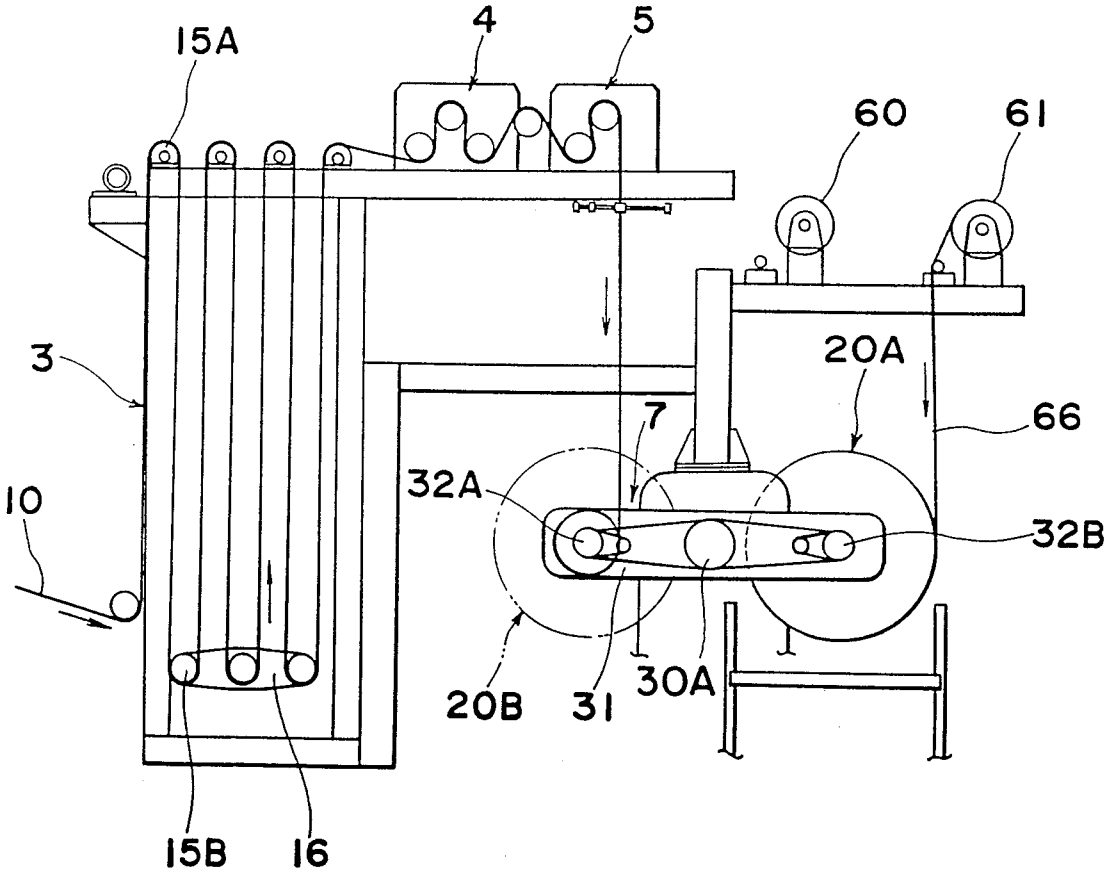
Figure 10:
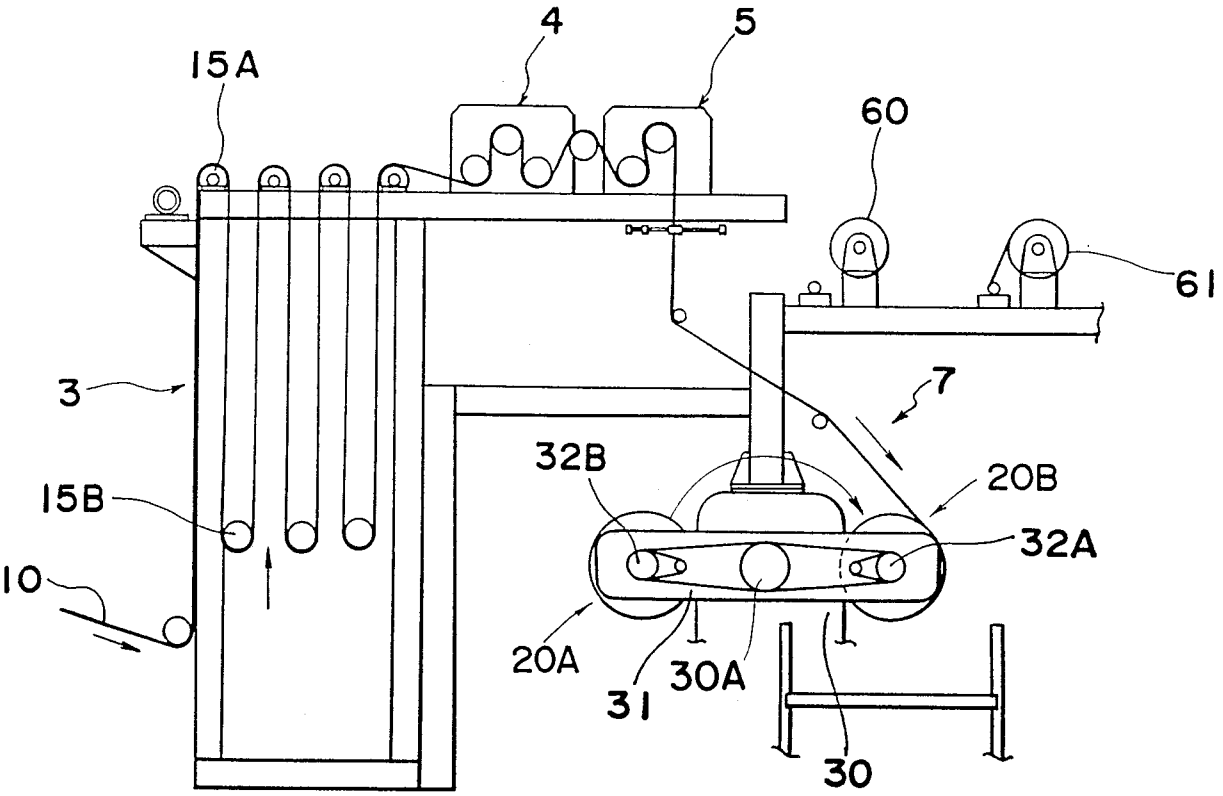

A winding process in which a winding change-over is effected alternately between two winding sections 20A and 20B will be described with reference to FIGS. 9–10(4).

An operation time chart showing the operations of the parts of the apparatus during the winding and winding changeover of the sheet-shaped molding material is shown in FIG. 9. As shown, the motor of the impregnating apparatus 1 and the accumulator 3 is continuously driven. A dancer roll, which is the lower rolls 15B of the accumulator 3, is located in the reference position during the winding operation, and moves downwardly during the winding operation up to the start of winding onto the B-shaft side 20B after the completion of winding on the A-shaft side 20A, and rises simultaneously with the resumption of the winding after change-over. The tension cut delivering apparatus 4 becomes inoperative only during the change-over operation so as to give proper tension to the sheet-shaped molding material 10 stored within the accumulator 3 during the winding changeover for effecting a tension cutting through the operation during the winding operation. The delivering apparatus 5 effects the delivering of the sheet-shaped molding material, stopping during the winding change-over and resuming after the winding change-over so as to deliver the sheet-shaped molding material to the appropriate side of the winding apparatus 7. The production cutter 6 is operated at the completion of winding on one side of the winding apparatus to cut the sheet-shaped molding material 10. In the winding apparatus 7, after the winding on the A-shaft side 20A, the winding is effected on the B-shaft side 20B. The operations of the chucks 37, the side plates 50, the guide film 65, and the outer film 66 in the respective winding sections are described in connection with FIG. 8. The paths of the sheet-shaped molding material 10, the guide film 65, and the outer film 66 to the winding apparatus 7 from the accumulator 3 during the winding and winding change-over are shown in FIGS. 10(1) through 10(4). FIG. 10(1) shows the condition at the time of change-over of winding onto the B-shaft side 20B after the completion of winding on the A-shaft side 20A. After sheet-shaped molding material 10 supplied to the A-shaft side 20A is cut by a cutter 6, the dancer rolls 15B start to descend to store the sheet-shaped material 10 being continuously fed from the impregnating apparatus 1 in the accumulator 3. At the same time, on the B-shaft side 20B, the winding of the guide film 65 around the core tube 21 starts. When the winding change-over has been completed, the dancer rolls 15B of the accumulator 3 are located at the bottom limit position as shown in FIG. 10(2). When the winding of the sheet-shaped molding material 10 starts on the B-shaft side after the completion of the winding change-over, the delivering apparatus 5 is operated to feed the sheet-shaped molding material 10 to the B-shaft side 20B so as to wind the sheet-shaped molding material 10 around the core tube 21B with the sheet-shaped molding material 10 being grasped between the turns of the guide film 65 and core tube. When the winding of the sheet-shaped molding material 10 starts as described above, the dancer roll 15B of the accumulator 3 starts to rise. During the winding on the B-shaft side 20B, the outer film 66 is wound on the outer peripheral face of the roll of sheet-shaped molding material 10 on the A-shaft side 20A as shown in FIG. 10(3). The product 100 is finished after the winding of the outer film 66 thereon. The product receiver 55 is raised to receive the product 100 from the A-shaft side 20A as described in connection with FIGS. 8(9) to 8(11). After the receipt of the product 100 on the A-shaft side, the winder main body 31 rotates through 180° with the support shaft **30*a* as a support point. The B shaft is wound in a rotated position as shown in FIG. 10(4)**.

In the embodiment, the side plates 50 are disc-shaped, but other shapes will be satisfactory as long as they prevent the lateral slippage when the sheet-shaped molding material 10 is wound around the core tube 21.

Figure 11:
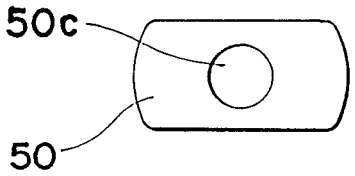
FIGS. 11(1) through 11(6) are elevation views each showing an example of the shape of a side plate.
Figure 11:
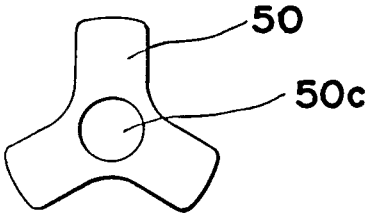
Figure 11:
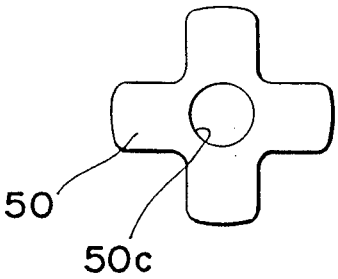
Figure 11:
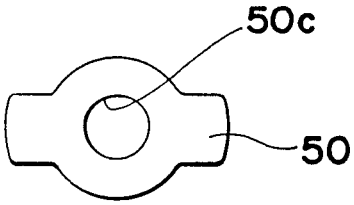
Figure 11:
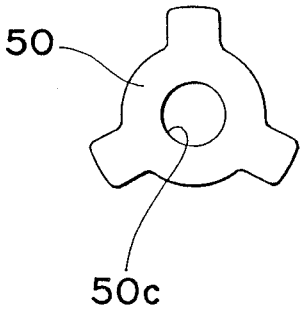
Figure 11:
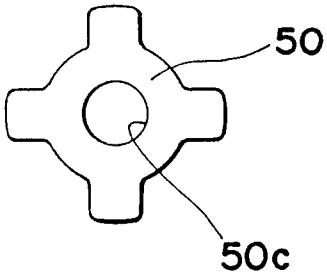

The various shapes as shown in FIGS. 11(1) through 11(6) may be used.

As is clear from the foregoing description, according to the winding apparatus of the sheet-shaped molding material of the present invention, the slippage in the width (axial) direction can be prevented when the sheet-shaped molding material is wound around the core tube, because the side plates are detachably mounted on both ends in the axial direction of the core tube. Thus, the slippage during the winding operation can be prevented, so that the weight of the material wound can be increased, whereby the thick, wide TMC may be rolled. Also, the guide film is wound onto the core tube at the start of the winding of the sheet-shaped molding material, and the sheet-shaped molding material is inserted between turns of the guide film for guiding the molding material onto the core tube, so that there are various advantages in that the winding may be smoothly started even in the case of the thick, wide TMC.

Although the present invention has been fully described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims unless they depart therefrom.

What is claimed is:

1. A winding apparatus for winding a sheet-shaped molding material of a compound composed of a paste-like resin material impregnated with a solid material such as glass fiber or the like and the compound having bottom and top carrier films, around a winding core tube into a roll of molding material, said apparatus comprising:

a frame means;

at least one winding means on said frame means, said winding means having a support means for supporting a winding core tube at a winding position therein, said support means having chucks which are detachably engagable with the opposite ends of a winding core tube for supporting the winding core tube therebetween in the winding position, and a driving mechanism for driving said chucks into and out of engagement with the winding core tube for supporting and releasing the winding core tube, respectively; and restricting means for restricting the movement of the sheet-shaped molding material in the direction of the width thereof during winding, said restricting means including side plates movably mounted along a winding core tube held in the winding position by said chucks for movement to and away from positions corresponding to the right and left sides of a roll of sheet-shaped molding material being wound on a winding core tube in the winding position for restricting movement of the sheet-shaped molding material in the width direction to prevent slippage during winding onto a winding core tube, and a side plate driving means connected to said side plates for moving said side plates to and away from said positions; and guide sheet means positioned adjacent said winding means for supplying a guide sheet and winding a leading end thereof onto a winding core tube prior to the start of winding of the sheet-shaped molding material, whereby the leading end of the sheet-shaped molding material is engaged by said carrier films of said sheet-shaped molding material for guiding the leading end of the sheet-shaped molding material onto the winding tube core, and means for cutting the guide sheet after the sheet-shaped molding material has started to be wound on the winding core tube.

2. An apparatus as claimed in claim 1 further comprising a wrapping sheet supply means positioned adjacent said winding means for supplying a wrapping sheet for being wound around a finished roll of sheet-shaped molding material after it has been wound up on a winding core tube.

3. A winding apparatus for winding a sheet-shaped molding material of a compound composed of a paste-like resin material impregnated with a solid material such as glass fiber or the like and the compound having bottom and top carrier films, around a winding core tube into a roll of molding material, said apparatus comprising:

a frame means;

at least one winding means on said frame means, said winding means having a support means for supporting a winding core tube at a winding position therein, said support means having chucks which are detachably engagable with the opposite ends of a winding core tube for supporting the winding core tube therebetween in the winding position, and a driving mechanism for driving said chucks into and out of engagement with the winding core tube for supporting and releasing the winding core tube, respectively; and restricting means for restricting the movement of the sheet-shaped molding material in the direction of the width thereof during winding, said restricting means including side plates movably mounted along a winding core tube held in the winding position by said chucks for movement to and away from positions corresponding to the right and left sides of a roll of sheet-shaped molding material being wound on a winding core tube in the winding position for restricting movement of the sheet-shaped molding material in the width direction to prevent slippage during winding onto a winding core tube, and a side plate driving means connected to said side plates for moving said side plates to and away from said positions; and guide sheet supply means positioned adjacent said winding means for supplying a guide sheet and winding a leading end thereof onto a winding core tube prior to the start of winding of the sheet-shaped molding material is engaged by said carrier films of said sheet-shaped molding material for guiding the leading end of the sheet-shaped molding material onto the winding tube core, and means for cutting the guide sheet after the sheet-shaped molding material has started to be wound on the winding core tube.

4. An apparatus as claimed in claim 3, in which said apparatus has a base and a frame supporting shaft on said base, and said frame means includes a pair of front a rear main bodies rotatably supported on said frame shaft for rotation through 180° and having left and right ends on opposite sides of the point at which said main bodies are supported on said frame shaft, said frame means having winding means on both the left and right ends of said main bodies, said winding means including a pair of chuck support shafts rotatably and slidably mounted on said main bodies, and said chucks each comprising a trapezoidal chuck body for engaging in the open end of a winding core tube and secured to the inner ends of each of said chuck support shafts, a fluid cylinder having an operating rod connected the outer end of each of said chuck support shafts and movable for moving the chucks toward and away from each other to support a winding core pipe in the winding position therebetween and to release the winding core pipe from the winding position, sprockets on at least one of said chuck support shafts in each pair and a chain engaged around said sprocket, and motor means connected to said chain for driving said chain for driving said chuck supporting shaft and the chuck supported thereon for driving the winding tube core in the winding position for winding the molding material thereon.

5. An apparatus as claimed in claim 3 in which each side plate has a side plate support member, and said restricting means further comprising fluid cylinders for each respective side plate mounted on said main bodies, a side plate guide bearing adjacent each of said fluid cylinders, each fluid cylinder having an operating rod with the end of the operating rod secured to a corresponding side plate support member, a guide shaft secured to each side plate support member and slidably engaged with the corresponding side plate guide bearing, guide roller means and groove means between said side plate support member and the corresponding side plate by which the side plate is rotatably mounted on each side plate support member.

* * * * *